United States Patent [19]

Camis et al.

[11] 4,408,865

[45] Oct. 11, 1983

[54] CORONA DISCHARGE DEVICE FOR ELECTROPHOTOGRAPHIC CHARGING AND POTENTIAL LEVELING

[75] Inventors: Thomas Camis, Boise; Paul R. Spencer, Meridian; Erwin H. Schwiebert, Eagle; Robert R. Hay, Boise, all of Id.

[73] Assignee: Hewlett Packard Company, Palo Alto, Calif.

[21] Appl. No.: 324,339

[22] Filed: Nov. 23, 1981

[51] Int. Cl.[3] ..... G03G 15/02

[52] U.S. Cl. ..... 355/3 CH; 250/324; 361/225

[58] Field of Search ..... 355/3 CH, 15, 14 CH; 250/324–326; 361/212, 214, 225

[56] References Cited

U.S. PATENT DOCUMENTS

| | | | |
|---|---|---|---|
| 3,324,291 | 6/1967 | Hudson | 250/325 |
| 3,678,350 | 7/1972 | Matsumoto et al. | 250/325 X |
| 3,778,623 | 12/1973 | Sato et al. | 250/325 |
| 4,034,221 | 7/1977 | Yanashita | 250/325 X |
| 4,141,648 | 2/1979 | Gaitten et al. | 355/14 CH |
| 4,201,465 | 5/1980 | Oyama et al. | 355/15 |

*Primary Examiner*—R. L. Moses

*Attorney, Agent, or Firm*—Jon R. Stark

[57] ABSTRACT

A corona discharge device for electrophotographic printing is provided in which erasing and primary charging functions are performed by a single device. A screened charging arrangement is used for ion steering, while simultaneous illumination by light produces charge carriers in the photoconducting layer of the drum. In one embodiment, a photochemically etched stainless steel screen is used.

5 Claims, 5 Drawing Figures

CORONA DISCHARGE DEVICE FOR ELECTROPHOTOGRAPHIC CHARGING AND POTENTIAL LEVELING

BACKGROUND OF THE INVENTION

Electrophotographic printing systems commonly employ a rotating photoreceptor drum as a medium for receiving images to be printed. Typically, a portion of the surface of the photoreceptor drum is charged to high electric potential and then exposed to light to form the desired latent image. Rotation of the drum then carries the image-bearing portion of the surface past devices which develop the image and then transfer it to a permanent medium such as paper. Further rotation of the drum brings that portion of the surface past an erasing device to prepare it for charging and exposure to a new image.

Following transfer of the image to paper, the image portion of the drum surface can have an electric potential anywhere between −300 and +500 volts. In the prior art, the erasing device used a corona in an attempt to bring this potential to near zero volts at all points. A separate charging device, called the primary corona, was then used to bring the drum potential up to approximately +1300 volts in preparation for exposure to a new image.

While functional, such systems were not entirely satisfactory in use because the resulting potential on the drum prior to exposure varied somewhat depending on the exposure and charging history of the drum. When the operating margin for the drum potential was low, as was the case near the end of normal drum or developer life, the variations in drum potential could lead to the appearance of traces of prior images in later printing. This problem was particularly severe when one image had been repeated many times; traces of this image could be seen in later prints of other images.

SUMMARY OF THE INVENTION

In accordance with the preferred embodiment of the present invention, a corona discharge device performs both potential leveling and charging functions in a single unit. Ions produced by corona wires are steered by a screen toward a photoreceptor drum for charging, permitting effective control of the potential at the drum. Simultaneously, illumination of a portion of the drum, by a light source shining through a slot in a corona shield, insures that charge carriers are present in the photoconductive layer of the drum. Drum potential variations are reduced, and drum lifetime is increased. In addition, the elimination of a separation erasing device reduces total printing system costs.

DESCRIPTION OF THE PREFERRED EMBODIMENT

Figure 1:
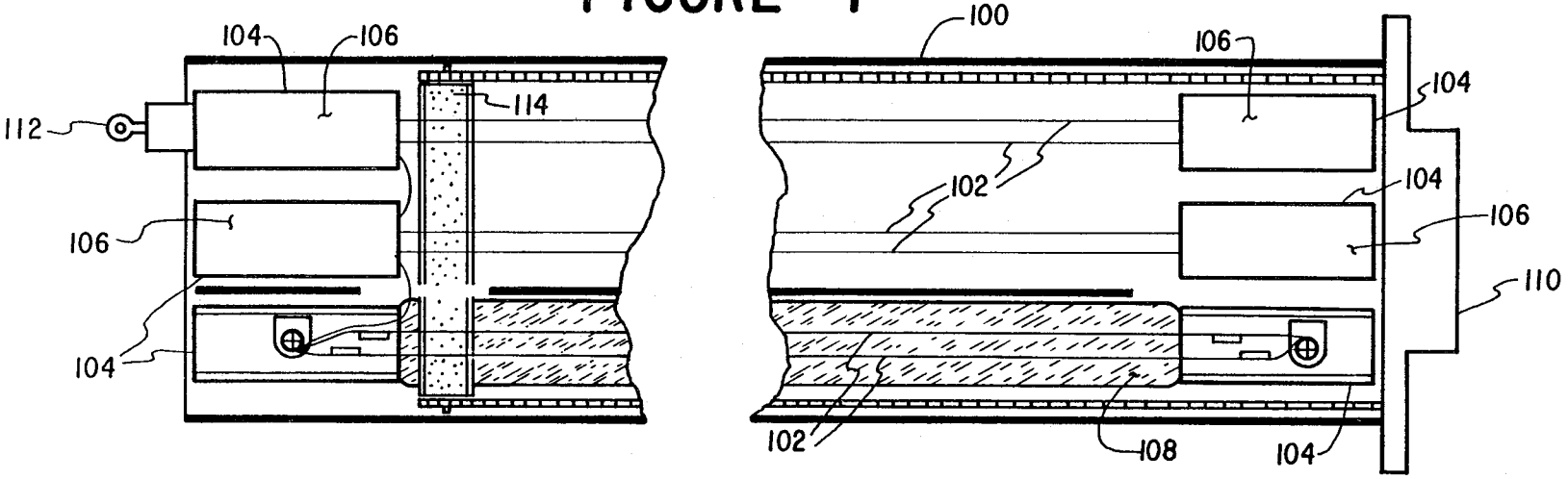
FIG. 1 shows a top view of a corona discharging device with the screen removed.

Referring now to FIG. 1, a shield 100, preferably of extruded aluminum, houses a set of corona wires 102, which are supported at the ends by insulating end blocks 104. In the preferred embodiment, corona wires 102 are made of tungsten, with a diameter of about 0.003 inches.

Insulating end blocks 104 must be able to withstand the 6–7 kilovolts d.c. which will be applied to wires 102, despite possible high temperatures and humidities. In addition, the material chosen for end blocks 104 must not support combustion if an electric discharge occurs. The preferred material for end block 104 is thus a mixture of mica and glass which can be molded and sintered, such as the material sold under the trademark Mycalex of the Spaulding Fiber Company. Other materials such as glass, ceramics or thermoplastics are also suitable, if capable of withstanding the conditions described.

A cap 106 is provided for each end block 104. Only four caps are shown in FIG. 1, two caps having been omitted to reveal the endblock beneath for clarity of presentation. Caps 106 may be molded from polytetrafluoroethylene, such as that sold under the trademark Teflon. Caps 106 and end blocks 104 are preferably about 4 cm in length.

The inside surfaces of shield 100 are preferably coated with an insulator, such as epoxy or an insulating tape. A slot 108 is provided in shield 100 so that light may be shined through to aid in potential leveling. A handle 110 may be affixed to the shield for convenience, if desired. One endblock 104 is provided with an electric connector 112 to deliver power to the corona wires 102, and a foam wire cleaner 114 for removing debris from wires 102.

Figure 2:
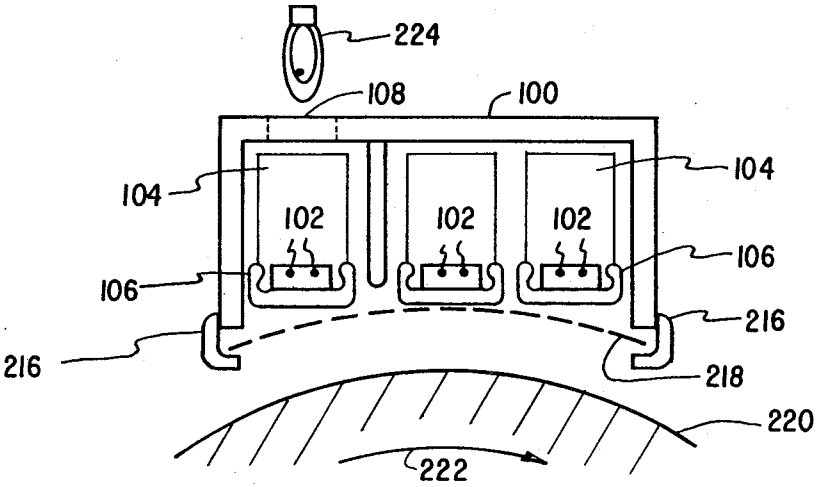
FIG. 2 shows an end view of a corona discharge device having a screen and a light source.

Referring now to FIG. 2, the preferred embodiment carries retaining rails 216 for a screen 218. Retaining rails 216 hold screen 218 under compression so that screen 218 assumes a curve approximating the curvature of a photoreceptor drum 220. The direction of rotation of drum 220 is shown by arrow 222. As drum 220 rotates, its surface is exposed to light from an incandescent light source 224 which shines through slot 108 and screen 218. Note that reference numerals 100 through 108 in FIG. 2 refer to the same numbered items in FIG. 1.

Figure 3:
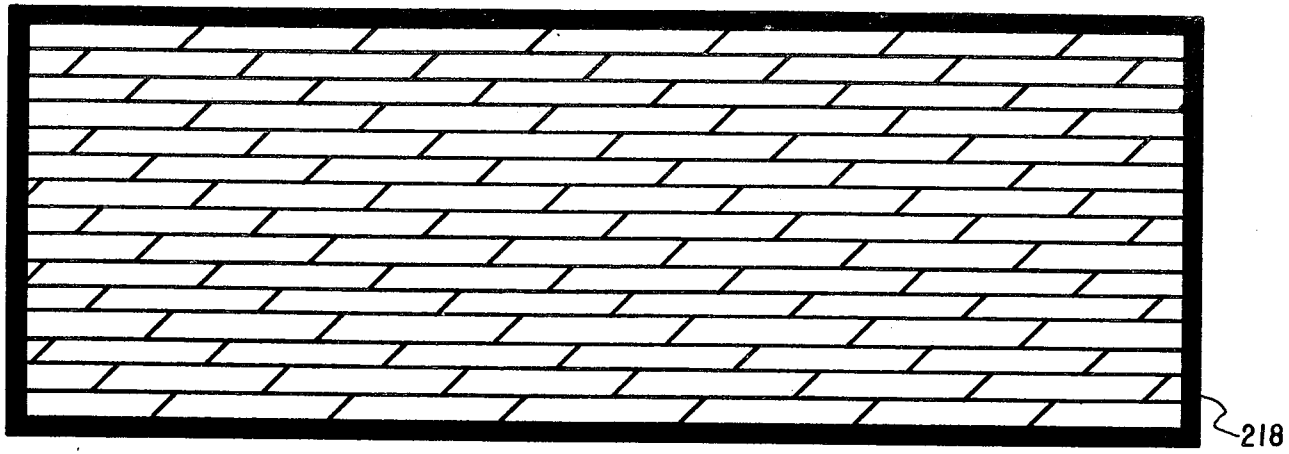
FIG. 3 shows the pattern preferred for a screen.
Figure 4:
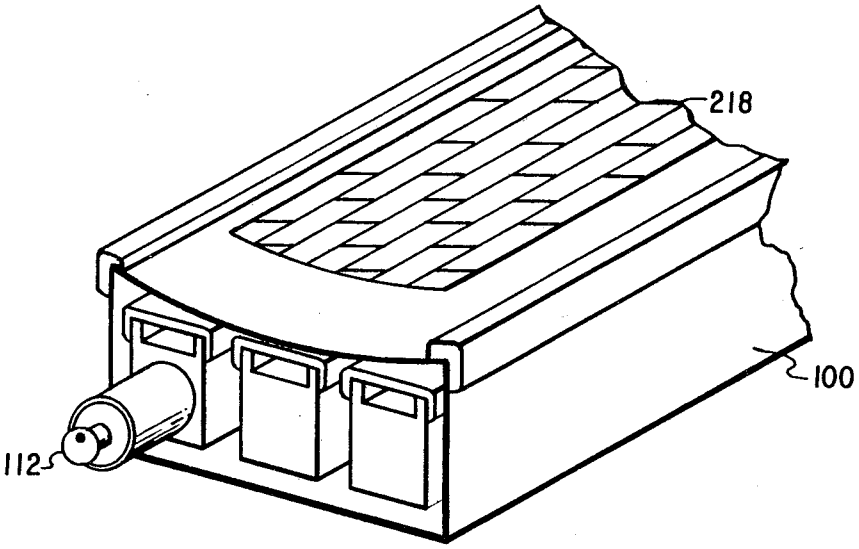
FIG. 4 shows a perspective view of a corona discharge device with the screen in place.

Screen 218 is preferably a stainless steel sheet of approximately 0.010 inch thickness, which has been photochemically etched to the pattern shown by FIG. 3. The appearance of screen 218 when in place is illustrated in FIG. 4. A fineblanking dye may also be used to form screen 218.

Figure 5:
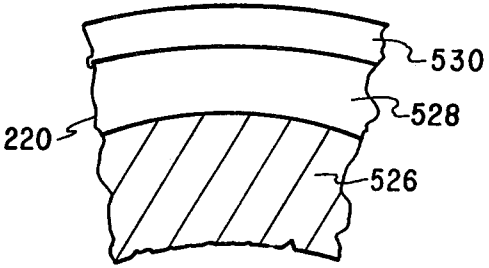
FIG. 5 shows a portion of a cross-section of a photoreceptor drum.

Referring now to FIG. 5, photoreceptor drum 220 has an aluminum substrate 526 supporting a photoconducting layer 528 and an insulating overcoat 530. Photoconducting layer 528 may be of CdS, preferably about 47 μm in thickness, while insulating overcoat 530 is about 23 μm thick. Illumination of drum 220 makes layer 528 conducting, allowing charge to pass through the photoconductor. After charging of the drum, the electric field is thus concentrated in the insulating overcoat 530 rather than in photoconducting layer 528.

Operation of the preferred embodiment can be understood by referring again to FIG. 2. When a high positive d.c. voltage is applied to corona wires 102, the electric field near the wires will produce a partial ionization of the surrounding air. Positive ions thus produced may be steered by controlling the potential at screen 218. The screen 218 and the shield 100 are maintained at a potential about 100 volts below the desired drum potential by a control circuit, which increases or decreases the current supplied to the corona wires to adjust the screen potential. The polarity of the electric field between wires 102 and screen 218 causes the positive ions to move toward the screen. These ions then pass through the screen and charge drum 220, which is at a potential as low as −300 volts when charging begins.

As ions are deposited on drum 220, the drum potential rises until it slightly exceeds the potential at screen 218. At this point the electric field between screen 218 and drum 220 begins to repel positive ions from the drum, and charging stops.

As each portion of the drum passes under slot 108, it is illuminated by incandescent source 224. This illumination causes the photoconductive layer of the drum to conduct, so that the potential across the photoconductive layer will be small. While incandescent is preferred, any light source may be used.

The preferred embodiment produces a potential on the drum which is nearly uniform spatially, and is largely independent of the charging and exposure history of the drum. This has the advantageous result of avoiding printing of traces of prior images. Since the prior image trace problem generally increased with drum age, elimination of this problem increases the effective useful life of a drum. In addition, the elimination of a separate erase device with its corresponding transformer and circuitry can produce a substantial savings in the total cost of an electrophotographic system.

We claim:

1. A corona discharge device for simultaneous potential leveling and uniform primary charging to a desired drum potential of a rotating photoreceptor drum of an electro-photographic printing device comprising:

a shield;

a plurality of corona wires within the shield, all of the corona wires being connected to receive a positive d.c. voltage, for producing positive ions;

a screen mounted on the shield for steering said positive ions toward said photoreceptor drum for charging said photoreceptor drum, the screen and the shield being maintained at a potential below the desired drum potential; and a continuously illuminating light source for illuminating a first portion of said photoreceptor drum while said first portion of said photoreceptor drum is being charged by said positive ions.

2. A corona discharge device as in claim 1 wherein said screen is a photochemically etched steel sheet.

3. A corona discharge device as in claims 1 or 2 wherein said light source is positioned so that light from said source passes between said corona wires and through said screen before reaching said photoreceptor drum.

4. A corona discharge device as in claim 3 wherein said light source is positioned so that a second portion of said photoreceptor drum is not illuminated while said second portion of said photoreceptor drum is being charged by said positive ions.

5. A corona discharge device as in claim 1 wherein said screen is a fineblanked steel sheet.

* * * * *

UNITED STATES PATENT AND TRADEMARK OFFICE

CERTIFICATE OF CORRECTION

PATENT NO. : 4,408,865

DATED : Oct. 11, 1983

INVENTOR(S) : Thomas Camis, et al,

It is certified that error appears in the above—identified patent and that said Letters Patent is hereby corrected as shown below:

Column 1, line 55, delete "separation" and insert "separate";

Column 1, line 60, delete "discharging" and insert"discharge".

Signed and Sealed this

*Third* Day of *January 1984*

[SEAL]

*Attest:*

GERALD J. MOSSINGHOFF

*Attesting Officer*

*Commissioner of Patents and Trademarks*